United States Patent [19]

Brass

[11] 4,053,766

[45] Oct. 11, 1977

[54] LAMP LENS STRUCTURE

[75] Inventor: John R. Brass, San Rafael, Calif.

[73] Assignee: U.S. Industries, Inc., New York, N.Y.

[21] Appl. No.: 643,930

[22] Filed: Dec. 23, 1975

[51] Int. Cl.[2] ..... F21V 13/04

[52] U.S. Cl. ..... 362/301; 362/223; 362/297

[58] Field of Search ..... 240/41.35 C, 41.1, 41 R, 240/41.3, 41.4 R, 103 R, 41.35 D, 41.36, 106.1

[56] References Cited

U.S. PATENT DOCUMENTS

| | | | |
|---|---|---|---|
| 3,539,799 | 11/1970 | Dangauthier | 240/41.35 R |
| 3,746,854 | 7/1973 | Brass | 240/41.36 |
| 3,944,810 | 3/1976 | Grindle | 240/103 R |

FOREIGN PATENT DOCUMENTS

| | | | |
|---|---|---|---|
| 78,970 | 9/1949 | Czechoslovakia | 240/41.3 |

*Primary Examiner*—Edna M. O'Connor
*Attorney, Agent, or Firm*—Bielen and Peterson

[57] ABSTRACT

A device for projecting light from a source to illuminate an area, having a lens, including at least two planar lens elements angularly disposed relative to each other. A first reflector is oriented to direct light from the source, substantially parallel to the first element and through said second element at a high angle of incidence which maximizes the passage of light and minimizes the secondary reflection of light from the source.

23 Claims, 3 Drawing Figures

10
12
14
16
20
22
24
26
28
30
32
50
52
54
58
62
64
66
68
70
76
78
86
86A
86B
88
88A
88B
94
94A
110
110A
110B
112
112A
112B
114
114A
114B
116
116A
116B
118
118A
120
120A
128
128A
128B
130
130A
130B
-2-

10
12
16
18
20
24
26
28
34
48
50
52
64
66
68
70
72
74
86
88
90
92
98
100
106
108
110
112
114
116
122
124
128
128A
128B
128C
130
130A
130B
130C
131
132
A
A'
B'
F
F'
G
G'
2°

LAMP LENS STRUCTURE

BACKGROUND OF THE INVENTION

The present invention relates to a novel illumination device.

The distribution of light from a source over an area has been a problem since the advent of mankind's effort to eliminate darkness. More specifically, the electrical lamps, incandescent, flourescent, arc discharge and the like, recently developed have been utiltzed in a variety of situations. Recent energy shortages have prompted the development of luminaires to ideally uniformly illuminate an area, especially with a combination of such luminaires. Safety considerations have also prompted a search for a device that illuminates an area susceptible to moving traffic, vehicular or otherwise.

One of the problems which has faced lighting research and development has been the elimination of the intense lumination from , luminaire toward the driver's of a car. Early developments have established the employment of sharp cutoff shields at about 75°. Since every automobile has a different roof line this figure is not precise. Complicating the problem is the fact that the area to be uniformly illuminated requires an uneven luminous intensity away from the luminaire with the maximum intensity concentrated at angles away from the straight down angle (0°). Another aspect of the problem is that light patterns from existing adjacent units will tend to be more uniform when such light patterns overlap, particularly when the spacing of the luminaires increases. This derives from the fact that surface reflectance is greater for light rays at large angles of incidence. Another consideration is that close spacing of the luminaires can provide excellent visibility but this system entails higher costs and more clutter than luminaires distributed in a sparcer pattern.

Although attempts have been made to produce smooth distribution of light patterns with curved reflectors, results have been disappointing. Improvements have been made employing a rectangular light pattern; the square being as the optimum shape for a lighting unit. For example, my U.S. Pat. No. 3,746,854, issued July 17, 1973, l describes a luminaire having special geometric criteria, so-called "tangent light planes." This prior device, was a step forward in luminaire design but offers the disadvantages of marginal heat radiating characteristics because of excessive redirecting of light back to the source and futher loss of projected light as a result of internal lens reflections. Difficulties arise from precise lamp placement, also.

Reference to my article "The Classification Dilemma for Sharp Cutoff Roadway Luminaires", Vol. 65, No. 3, Illumination Engineering, March 1970 recognizes the need for a Maximum Candle Power Angle, thus permitting formation of a maximum candle power beam between maximum candle power planes.

As will be seen from the prior knowledge, the need for a maximum intensity beam at high angles in relation to the straight down axis becomes a greater problem as the maximum candle power angle increases. This, of course, is a result of the illuminance on a surface decreasing inversely as the square of the distance from the source.

No satisfactory luminaire is known that will substantially produce a uniform surface distribution of light at high angles of projection from the source.

SUMMARY OF THE INVENTION

In accordance with the present invention a photometric device or luminaire is provided, having a lens including at least two lens, planar elements, angularly disposed in relation to each other. A first reflector orients to direct light from the source parallel to the first planar element and below the source. The reflected light passes through the second planar element at a low angle of incidence because of the lens element's angular orientation. Thus, a maximum candle power beam exits from the device at high angular projections with respect to the straight-down or zero angle. In this basic form the invention permits a maximum candle power beam to illuminate an area at less than the cutoff angle of the device. Overlapping light patterns from adjacent luminaire results in nearly uniform light patterns with the adjacent maximum candle power beams lying next to each other on the surface to be illuminated. Hence, the light projected at an angle greater than the maximum candle power beam but less than the cutoff angle, illuminates the surface which is also being illuminated by the adjacent luminaire.

Greater projection of light occurrs in the subject invention at high angles because the internally reflected light impinges on the novel lens structure at a lower angle in incidence.

Ideally, the angular orientation of the first and second planar lens elements coincides with the maximum candle power angle of light to be projected, which, as heretofore described, is less than the cutoff angle of the device.

The device may also include an upper peripheral reflector which reflects light substantially parallel to the second planar element, below the source, and through the first planar element of the lens. Of course, pairs of perpendicularly disposed reflectors constituting the first and second reflectors may be employed to project rectangular and/or square light patterns on the area to be illuminated. In conjunction with the two pairs of reflectors are first, second, third and fourth planar lens elements which may form a lens with a pyramidal configuration.

To further reinforce the maximum candle power beam, the device may also include an upper peripheral reflector which again reflects light from the source substantially parallel to the first planar lens element above the source and through the second planar element. The upper peripheral reflector may include a plurality of such reflectors performing the same function, such that the reflected light passes through at least one of the lens elements. Another upper peripheral reflector in opposed disposition to the first upper peripheral reflector, reflects light substantially parallel to the second lens element and through the first lens element.

The device may also include first and second reflector systems each having a multiplicity of facets, the lowest of the facets. The facets are disposed to produce at least the image of the source and reflect the corresponding rays away from the source and through the second and first planar lens elements.

Thus, a device projecting a maximum candle power beam at high angles away from the straight down angle results. When the projected light from the luminaire reaches the area to be illuminated it will have uniform brightness to an observer traveling on the ground.

It is therefore an object of the present invention to provide a photometric device or luminaire capable of projecting light onto an area to be illuminated in a uniform light pattern.

It is another object of the present invention to provide a luminaire which has a maximum candle power angle for the projection of a maximum candle power beam at high angles with respect to a zero (0) straight down angle of projection.

It is yet another object of the present invention to provide a luminaire which minimizes internal reflection from the inside lens surface and directs a substantial portion of the light from the source away from the source, thus preventing over heating of the source and producing efficient projection of light from the luminaire.

Another object of the present invention is to provide a photometric device having maximum candle power beams at an angle less than the cutoff angle of the device and a minimum candle power beam at the straight down (0) angle.

A further object of the present invention is to provide a photometric device which employes a series of reflectors and angularly planar lens elements to pass reflected light from a source through the lens at low angles of incidence to optimize such passage of light.

It is yet another object of the present invention to provide a photometric device capable of being compactly assembled to allow its installation with ease and efficiency.

DESCRIPTION OF THE PREFERRED EMBODIMENTS

Figure 1:
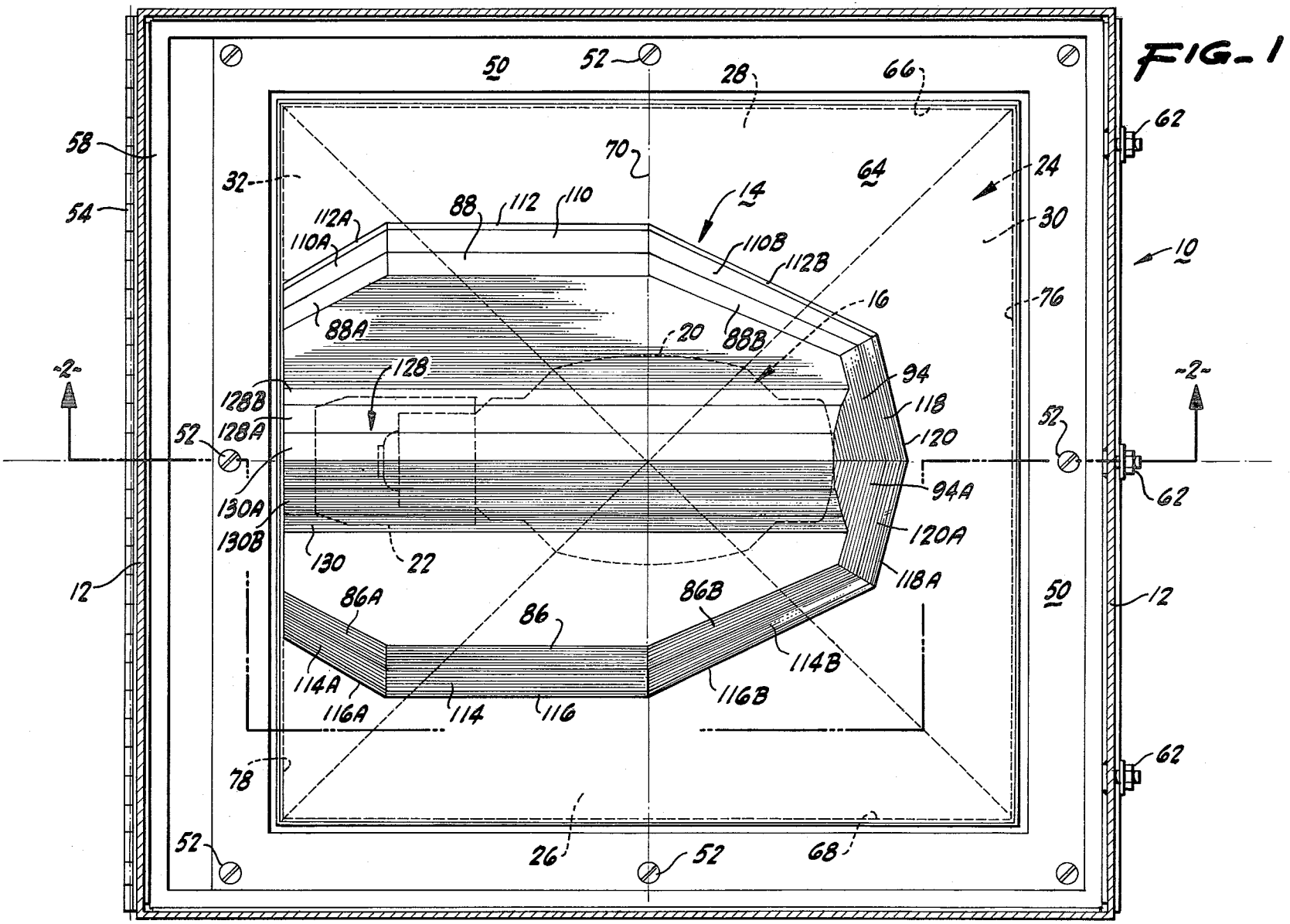
FIG. 1 is top plan view of the invention partially in section.

The invention in its entirety is denoted by reference character 10 and includes a casing 12 which surrounds and encloses the light projecting portion 14; which includes the light source 16 and reflectors, which will be further described herein.

Figure 3:
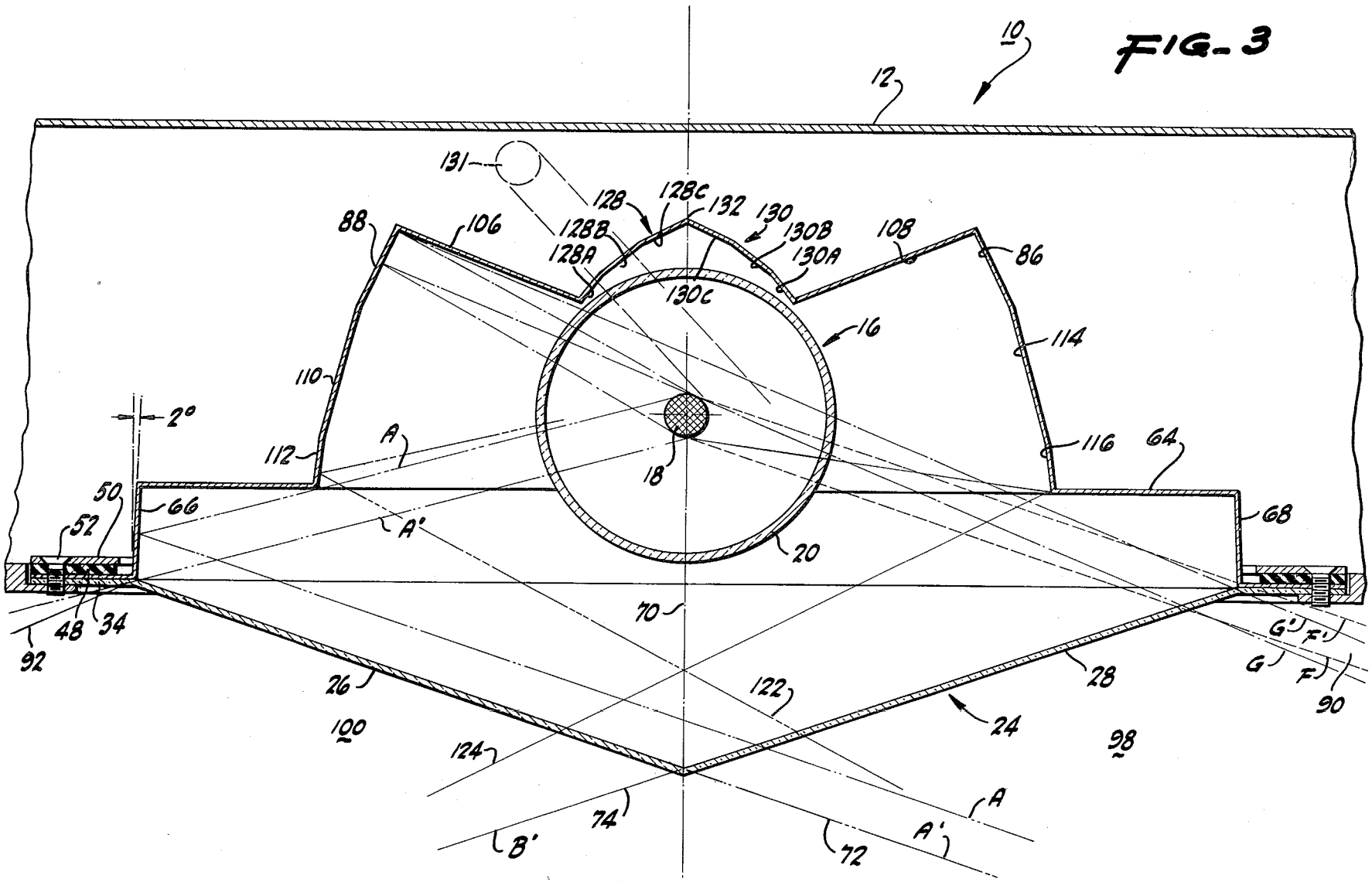
FIG. 3 is a slightly enlarged view taken along line 3—3 of FIG. 2.

The source of light 16 may be of an incandescent, flourescent or arc discharge type of lamp. As shown in the drawings, an arc discharge lamp has been employed to illustrate the present invention. For example, a High Intensity Discharge, 1000 Watt, model number M1000/c/BUH, manufactured by Sylvania, may be used for this purpose, although other similar lamps would also suffice As depicted in FIG. 3 the lamp includes an arc tube 18 and an envelope 20. Since the arc tube is not a point source, the image reflection of the arc tube 18 takes the form of a circle in cross section. Light source 16 removably fits into socket 22 which connects to a proper power source, the provision of which is well known in the art.

Casing 12 generally would be supported above the area to be illuminated by a stanchion at a predetermined mounting height or the like (not shown). Casing 12, in turn, encloses and supports the light projecting portion 14 which includes as one of its components, lens 24 having at least a first planar lens element 26 and a second planar lens element 28, angularly oriented with respect to each other. In the embodiment shown, the lens element 30 and 32 may form a pyramidal shaped lens 24 in conjunction with elements 26 and 28 (Shown in phantom FIG. 1). The lens 24 generally encloses the area beneath the source. In this respect it should be noted that the lens is "below" the source, for the purpose of convention but it is anticipated the device 10 may be oriented to illuminate an area above or lateral with respect to the source 16.

Each lens element 26, 28, 30 and 32 has a flat flange 34, 36, 38 and 40 that extends beyond the angularly oriented portions of the lens elements. As is most clearly illustrated in FIG. 2, the interior of the light projection portion 14 seals by sandwiching a plate 42 (which extends about the perimeter of casing 12) flanges 34, 36, 38 and 40, flange 46, seal 48 and plate 50. Set screw 52, which is exemplary of a number such set screws, holds the sandwich together until entry into the interior of light projecting portion is desired. Seal 48 may be of any sealing material such as cork, elastomer and the like.

The light projecting portion 14 further depends from casing 12 on hinge 54 which welds or otherwise affixes to plate and casing 12. L-bracket 56 extends around three sides of casing 12. Casing flange 58 and bracket 56 holds seal 60 and plate 42 to enclose the casing 12 and the exterior of light projecting portion 14. Of course, on one side of the device hinge 54 serves the same function as the lower portion of bracket 56, in this regard. Fastening means 62 serves to retain bracket 56 and the seal, heretofore described, in place.

The light projecting portion 14 includes a support pan 64 which may serve as a mount for an electrical apparatus such as a transformer, ballast and the like.

A first reflector 66 and a second reflector 68 (FIG. 3) orient to reflect light from the arc tube 18 at a maximum candle power (abbreviated MCP) angle from the device 10. The rays A and A′ indicate such a reflection from reflector 66 which subtends an angle of about 2° with the vertical axis 70 of FIG. 3, as marked. Reflector 68 also directs light at an MCP angle, the apex of which is located 180° from the apex of the MCP angle of rays A and A′. As can be seen, the light ray A′ lies along a first maximum candle power plane 72. Reflector 68 directs light in a manner similar to reflector 66, i.e., ray B′ being along a second MCP plane 74 (light ray B′ partially shown for the sake of simplicity)

Third and fourth reflectors 76 and 78 (FIG. 2) substantially parallel other and substantially perpendicular to each to the first and second reflectors 66 and 68, form a rectangular body about the periphery of arc tube 18. Reflector 76 produces reflected rays C–C′, ray C′ being in a third maximum candle power plane 80 while reflector 78 projects light at a MCP angle, the apex of which lies 180° about axis 70 from the apex of the angle of reflection of rays C–C′ from reflector 76. Reflected ray D′ (partially shown) lies in a fourth MCP plane 82.

The light reflected from reflectors 66, 68, 76 and 78 pass through lens elements 28, 26, 32 and 30 respectively. The lens elements lie at an angle to the horizontal in order to reduce the angle of incidence of the light rays reflected at MCP angles. Such reduction increases the transmission of the MCP light rays; the illustrated MCP angle of the reflected ray is about 66° from the axis 70 measured upwardly.

Reference to the publications Photometry, J. W. T. Walsh, 1965 pages 1555 161 and 162 or I.E.S. Handbook, 1966, pages 6-2, demonstrates the comparison of transmission factors for non-polarized light with flat glass at various angles of incidence. In the present invention, the rays of light, impinging on lens elements 26, 28, 30 and 32, after reflection from reflectors 68, 66, 78 and 76 respectively,, have a lower angle of incidence than if the lens 24 were horizontal and planar. A curvilenear lens would transmit light at a variety of angles causing glare. On the average the transmission factor for reflected light in the present invention increases by about forty percent (40%) over the prior art. Such increase of transmission correspondingly reduces internal reflectance which increases the light projection efficency and reduces the reflection of light back to the source; a factor in overheating of the source.

The lens elements ideally would be angularly disposed at the MCP angle plus or minus 5° (measured downwardly from axis 70). A shallower angle would project images of images on the lens elements, back into the device 10. A greater angle would create a glare i.e.: light would be projected beyond the cutoff angle of the device 10, to be more fully defined as the specification continues.

The lens elements 26, 28, 30 and 32 do reflect some light from the source. For example, ray E, FIG. 2, which may be internally reflected light, refects from lens element 32 at point 84 and passes through lens element 30 at a relatively low angle of incidence but no greater than the cutoff angle of the device 10, to be described hereinafter.

With reference to FIG. 3 a direct set of rays F–F′ determines the cutoff angle of the device 10. In the present case, the cutoff angle is about 75°. Luminaire 10 may have cutoff angles spread between 60° and 80°, measured upwardly from axis 70; a straight down angle of zero degrees (0°).

Reinforcing the MCP plane light from the lower reflectors 62, 64, 66 and 68 of device 10, is a fifth or first upper peripheral reflector 88 and a sixth or second upper peripheral reflector 88. Rays G–G′ from arc tube 18 pass above the arc tube 18 after reflection from reflector 88. The fifth and sixth reflectors may take the form of a plurality of reflectors. Reflector 86 includes reflectors 86A and 86B. The light reflected from a plurality of fifth reflectors 88 is coplanar and directed at an MCP angle within a fifth MCP plane 92. A sixth MCP plane 90 contains the light reflected from a plurality of sixth reflectors 86. Seventh reflectors 94 and 94A reflect source light within a seventh MCP plane 96, FIG. 2.

Figure 2:
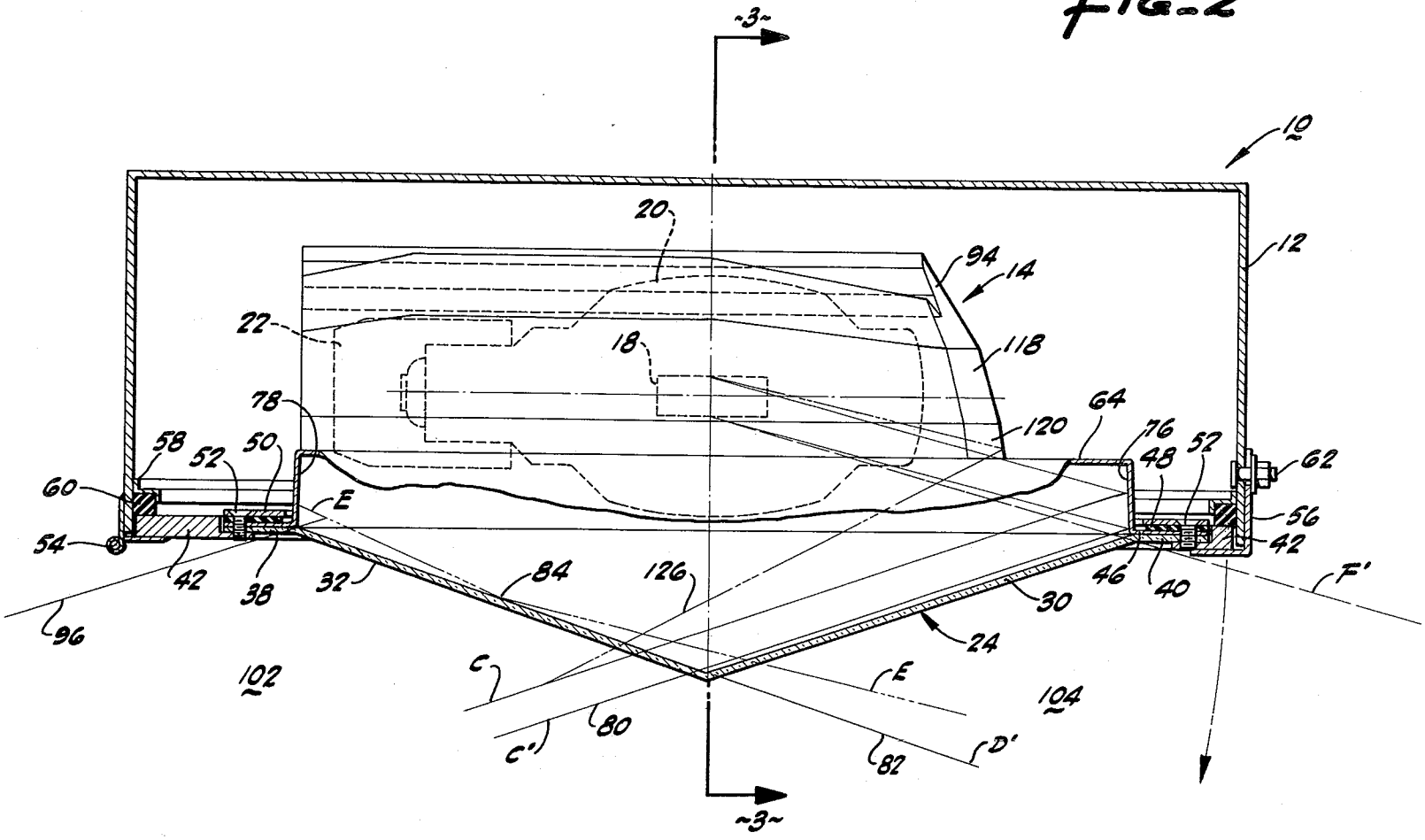
FIG. 2 is a partially broken view taken along line 2—2 of FIG. 1.

As can be surmised from FIGS. 2 and 3, the light passing between first and fifth maximum candle power planes 72 and 90 define a first maximum candle power beam 98. A second MCP beam 100 lies between second and sixth MCP planes 74 and 92. A third maximum candle power beam 102 forms between MCP planes 80 and 96. Lastly, fourth MCP plane 82 results in MCP beam 104.

The MCP beams produce a rectangular frame-like light pattern adjacent device 10, but the overall light pattern or the area illuminated is of uniform brightness. The device of the present embodiment designedly projects a rectangular light pattern a distance of about two mounting heights in front, a distance of about three mounting heights laterally and a distance of about one mounting toward the rear. As shown on FIG. 1, device 10 would ideally be placed on a street such that the "front" would be on the street side, and the "rear" would be on the house side. It would be obvious to one of ordinary skill in the art to alter the present embodiment, such that other dimensioned rectangular light patterns could be obtained.

The angularly disposed reflectors 86A, 86B, 88A and 88B, produce coplanar light with reflectors 86 and 88 respectively, that results in uniform brightness in the corners of the rectangular frame-like light pattern. Sloping reflectors 106 and 108 are oriented at the MCP angle to permit the rays in MCP planes 90 and 92 to pass unhindered through the lens elements 26 and 28. Reflectors 110, 112, 114, 116, 118 and 120 again direct source light into MCP beams 98, 100 and 102. The rays 122, 124 and 126 reflected from corresponding reflectors 112, 116 and 120 create a slightly diverging effect to MCP beams 98, 100 and 102 at their outer extremeties. Reflectors 110, 112, 114, 116, 118 and 120 are faceted as are reflectors 86 and 88 and 94; the letters A and B have been added to the reference characters for the purpose of denoting corresponding facets.

Above the arc tube 18 the device 10 includes a first reflector system 128 facets denoted by the upper case letter A, B and C. The system 128 functions to direct overhead light from arc tube 18 away from the arc tube and out to the area illuminated at relatively high angles, FIG. 3. The light reflected therefrom will pass through MCP beams 98 and 100 to reinforce the area illuminated by these beams as well as adjacent areas. The facet 128A is constructed to project at least the image 131 of arc tube 18 through planar lens element 28. A second reflector system 130 is substantially symetrical with system 128 but directs light through lens element 26. Each facet 128A, 128B, 128C, 130A, 130B and 130C is constructed to produce the whole image of arc tube 18 and reflect the rays of such image through lens elements 26 and 28. These facets may form a peak 132 above the light source 16 which intersects axis 70.

In operation the light from arc tube 18 passes directly through lens 24 within the cut-off angles of the device 10 (about 75°). Lateral light above the cut-off angle from arc tube 18 reflects from specular surfaces 66, 68, 76 and 78 at MCP angles and within MCP planes to produce MCP beams 98, 1005, 102 and 104. Reflectors 86, 88 and 94 reinforce the MCP beams by directing light from arc tube 18 traveling in somewhat upward direction. Both sets of reflectors are oriented to avoid light reflection back to arc tube 18; reflectors 86, 88 and 94 direct reflected rays above arc tube 18 while reflectors 66, 68, 76 and 78 direct light below the arc tube 18. The lens 24 has angularly disposed elements 26, 28, 30 and 32 which enhance passage of light rays therethrough by presenting a favorable angle of incidence with the rays of light traveling from the reflectors.

The reflectors 110, 112, 114, 116, 118 and 120 further reinforce the MCP beams. Overhead light is reflected at high angles by the reflector systems 128 and 130 to further reduce the possibility of overheating arc tube 18. Thus, a rectangular light pattern illuminates a surface with uniform brightness. The MCP beams 98, 100, 102 and 104 form a frame-like pattern about the periphery of the rectangular light pattern which would only be measurable immediately adjacent the luminaire 10, since the brightness of the entire rectangular light pattern would be uniform a certain distance from device 10 on the illuminated surface.

While in the foregoing specification an embodiment of the invention has been set forth in considerable detail for the purposes of making a complete disclosure thereof, it will be apparent to those skilled in the art that numerous changes may be made in a such details without departing from the spirit and principles of the invention.

What is claimed is:

1. A device for projecting light to illuminate an area comprising:

a. light source;

b. lens having at least a first planar element, a second planar element, a third planar element, and a fourth planar element and said first planar element angularly oriented with respect to said second planar element and said third and fourth planar elements angularly oriented with respect to each other and to said first and second planar elements forming a pyramidal shaped lens;

c. first reflector oriented to reflect light from said source substantially parallel to said first planar element, a definable portion of the reflected light passing below said source and through said second planar element in a first maximum candle power plane from said device to the area to be illuminated;

d. second reflector oriented to reflect light from said source substantially parallel to said second planar element, a definable portion of the reflected light passing below said source and through said first planar lens element in a second maximum candle power plane from said device to the area to be illuminated.

2. The device of claim 1 which additionally comprises a third and a fourth reflector in substantially parallel disposition to each other, said third and fourth reflectors forming a substantially rectangular body in combination with said first and second reflectors, said third and fourth reflectors being oriented to reflect light from the source substantially parallel to said third and fourth planar lens elements respectively a definable portion of said light from said third and fourth reflectors passing below said source and through said fourth and third planar lens elements respectively in a third and fourth maximum candle power plane from said device to the area to be illuminated.

3. The device of claim 2 in which a definable portion of the reflected light passing through said third and fourth planar lens elements travels in a third and fourth maximum candle power plane.

4. The device of claim 3 which additionally comprises a fifth reflector oriented to reflect light from the source substantially parallel to said first planar lens element, the reflected light passing above the source and through said second planar element to the area to be illuminated.

5. The device of claim 4 which additionally comprises a sixth reflector oriented to reflect light from the source substantially parallel to said second planar element, the reflected light passing above said source and through said first planar element to the area to be illuminated.

6. The device of claim 3 in which said sixth reflector comprises a plurality of reflectors oriented to reflect a definable portion of the light from the source substantially parallel to said first planar lens element in a fifth maximum candle power plane.

7. The device of claim 6 in which said sixth reflector comprises a plurality of reflectors oriented to reflect a definable portion of light from the source substantially parallel to said second planar lens element, in a sixth maximum candle power plane.

8. The device of claim 1 which additionally comprises a fifth reflector oriented to reflect light from the source substantially parallel to said first planar lens element, the reflected light passing above the source and through said second planar element to the area to be illuminated.

9. The device of claim 8 in which said fifth reflector comprises a plurality of reflectors oriented to reflect a definable portion of light from the source substantially parallel to said first planar lens element, in a fifth maximum candle power plane.

10. The device of claim 9 which additionally comprises a sixth reflector oriented to reflect light from the source substantially parallel to said second planar element, the reflected light passing above said source and through said first planar element to the area to be illuminated.

11. The device of claim 10 in which said sixth reflector comprises a plurality of reflectors oriented to reflect a definable portion of light from the source substantially parallel to said second planar lens element, in a sixth maximum candle power plane.

12. The device of claim 11 which additionally comprises a plurality of seventh reflectors oriented to reflect a definable portion of light from the source substantially parallel to said fourth planar lens element in a seventh maximum candle power plane, the reflected light passing above the source and through said third planar lens element to the area to be illuminated, the light passing between said first maximum candle power plane and said fifth maximum candle power plane defining a first maximum candle power beam of light; the light passing between said second maximum candle power plane and said sixth maximum candle power plane defining a second maximum candle power beam of light, the light passing between said third maximum candle power plane and said seventh maximum candle power plane defining a third maximum candle power beam of light, the light passing along said fourth maximum candle power plane defining a fourth maximum candle power beam of light. the beams of light producing a maximum candle power zone of light on the area illuminated.

13. The device of claim 12 which additionally comprises a first reflector system including a multiplicity of reflector facets, each of said facets producing at least the image of the source and reflecting the corresponding rays away from the source and through the second planar element.

14. The device of claim 13 which additionally comprises a second reflector system including a mulitplicity of reflector facets, each of said facets producing at least the image of the source and reflecting the corresponding rays away from the source and through the first planar element, said upper facets of said first and second reflector systems meeting each other above the source.

15. The device of claim 1 in which said light source is a arc lamp.

16. The device of claim 1 in which said device mounts along a street.

17. A device for projecting light to illuminate an area comprising:

a. light source;

b. lens having at least a first planar element and a second planar element, said first element angularly oriented with respect to said second element;

c. first upper peripheral reflector oriented to reflect light from the source substantially parallel to said first planar lens element, the reflected light passing above said source and through said second planar lens element in a maximum candle power plane to the area to be illuminated.

18. The device of claim 17 which additionally comprises a first sloping reflector positioned against said first upper peripheral reflector and angularly oriented coincident to substantially a maximum candle power angle of said device.

19. The device of claim 18 having a second upper peripheral reflector and a second sloping reflector in opposing relationship with said first upper peripheral reflector and sloping reflector.

20. The device of claim 19 which additionally comprises a second reflector oriented to reflect light from the source substantially parallel to said second planar element, a definable portion of said light passing below said source and through said first planar lens element in a second maximum candle power plane from said device to the area to be illuminated.

21. The device of claim 20 in which said lens additionally includes third and fourth planar elements angularly oriented with respect to each other and said first and second planar elements, said elements forming a pyramidal shaped lens.

22. The device of claim 21 which additionally comprises a first reflector system including a multiplicity of reflector facets each of said facets producing at least the image of the source and reflecting the corresponding rays away from the source and through the second planar elements.

23. The device of claim 22 which additionally comprises a second reflector system including a multiplicity of reflector facets each of said facets producing at least the image of the source and reflecting the corresponding rays away from the source and through the first planar element, said upper facets of said first and second reflector systems meeting each other above the source.

* * * * *